US008803051B2

(12) United States Patent
Lee et al.

(10) Patent No.: US 8,803,051 B2
(45) Date of Patent: Aug. 12, 2014

(54) MICROWAVE OVEN

(75) Inventors: Sang-Ryul Lee, Changwon (KR); Kyu-Young Kim, Changwon (KR); Jae-Myung Chin, Changwon (KR); Dong-Han Kim, Changwon (KR); Si-Young Choi, Changwon (KR); Sung-Ho Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 985 days.

(21) Appl. No.: 12/935,804

(22) PCT Filed: Apr. 1, 2009

(86) PCT No.: PCT/KR2009/001670

§ 371 (c)(1),
(2), (4) Date: Mar. 2, 2011

(87) PCT Pub. No.: WO2009/145460

PCT Pub. Date: Dec. 3, 2009

(65) Prior Publication Data

US 2011/0147378 A1 Jun. 23, 2011

(30) Foreign Application Priority Data

Apr. 1, 2008 (KR) ..... 10-2008-0030146

(51) Int. Cl.
*H05B 6/64* (2006.01)
*H05B 6/70* (2006.01)

(52) U.S. Cl.
USPC ..... 219/756; 219/746

(58) Field of Classification Search
CPC ..... D01F 11/16; H05B 6/708
USPC ..... 219/756, 695, 746, 751, 754, 757, 749, 219/750, 710, 681; 29/729, 739; 118/723 MW, 723 AN, 723 MP; 204/298.38
See application file for complete search history.

(56) References Cited

U.S. PATENT DOCUMENTS

2003/0102307 A1* 6/2003 Kang ..... 219/746

FOREIGN PATENT DOCUMENTS

| | | |
|---|---|---|
| KR | 1996-0011271 | 8/1996 |
| KR | 10-1999-017601 | 3/1999 |
| KR | 1999-017601 | 3/1999 |
| KR | 10-0200063 | 6/1999 |
| KR | 10-2000-0009767 | 2/2000 |
| KR | 10-0593073 | 6/2006 |

OTHER PUBLICATIONS

Korean Notice of Allowance dated Nov. 30, 2010.
Korean Office Action dated Nov. 30, 2009.
International Search Report issued in PCT/KR2009/001670 dated Nov. 10, 2009.

* cited by examiner

*Primary Examiner* — Quang Van
(74) *Attorney, Agent, or Firm* — Ked & Associates, LLP

(57) ABSTRACT

A microwave oven includes a cavity having a cooking chamber; a magnetron oscillating microwave radiation used for cooking food in the cooking chamber; and a plurality of radiation openings through which the microwave radiation is radiated into the cooking chamber, each of the radiation openings having a length in a direction where the microwave radiation is guided by a waveguide, the length being greater or less than λ/4.

13 Claims, 1 Drawing Sheet

MICROWAVE OVEN

TECHNICAL FIELD

The present disclosure a microwave oven, and more particularly, to a microwave oven that can more effectively cook food.

BACKGROUND ART

A microwave oven is a kitchen appliance that employs microwave radiation primarily to cook or heat food. The microwave oven is designed such that microwave radiation is oscillated from a magnetron and radiated into a cooking chamber by being guided by a waveguide. The cooking chamber is provided with a radiation opening through which the microwave radiation guided by the waveguide is radiated into the cooking chamber. However, a size of the radiation opening is a major factor that determines the radiation uniformity of the microwave. However, the related art is not reflecting this consideration.

DISCLOSURE OF INVENTION

Technical Solution

Embodiments provide a microwave oven that is configured to uniformly distribute microwave radiation throughout an interior of a cooking chamber.

In one embodiment, a microwave oven includes: a cavity having a cooking chamber; a magnetron oscillating microwave radiation used for cooking food in the cooking chamber; and a plurality of radiation openings through which the microwave radiation is radiated into the cooking chamber, each of the radiation openings having a length in a direction where the microwave radiation is guided by a waveguide, the length being greater or less than $\lambda/4$.

In another embodiment, a microwave oven includes: a cavity having a cooking chamber; a magnetron having an antenna oscillating microwave radiation used for cooking food in the cooking chamber; a first radiation opening through which the microwave radiation is radiated into the cooking chamber, the first radiation opening having a length in a direction where the microwave radiation is guided by a waveguide, the length being greater than $\lambda/4$; and a second radiation opening through which the microwave radiation is radiated into the cooking chamber, the second radiation opening having a length in a direction where the microwave radiation is guided by a waveguide, the length being less than $\lambda/4$, wherein a distance between the first and second radiation openings in a length direction of the waveguide is a mean value of the lengths of the first and second radiation openings.

In still another embodiment, a microwave oven includes: a cavity having a cooking chamber; a magnetron oscillating microwave radiation used for cooking food in the cooking chamber; a first radiation opening through which the microwave radiation guided by a waveguide is radiated into the cooking chamber; and a second radiation opening through which the microwave radiation guided by the waveguide is radiated into the cooking chamber, wherein lengths of the first and second radiation openings in a length direction of the waveguide and a distance between the first and second radiation openings in the length direction of the waveguide are $\lambda/8$ (n is an integer).

Advantageous Effects

According to the embodiments, since the microwave radiation is uniformly distributed in the cooking chamber, the cooking of food can be more effectively realized.

BEST MODE FOR CARRYING OUT THE INVENTION

The details of one or more embodiments are set forth in the accompanying drawings and the description below. Other features will be apparent from the description and drawings, and from the claims.

Mode for the Invention

Reference will now be made in detail to the embodiments of the present disclosure, examples of which are illustrated in the accompanying drawings.

Figure 1:
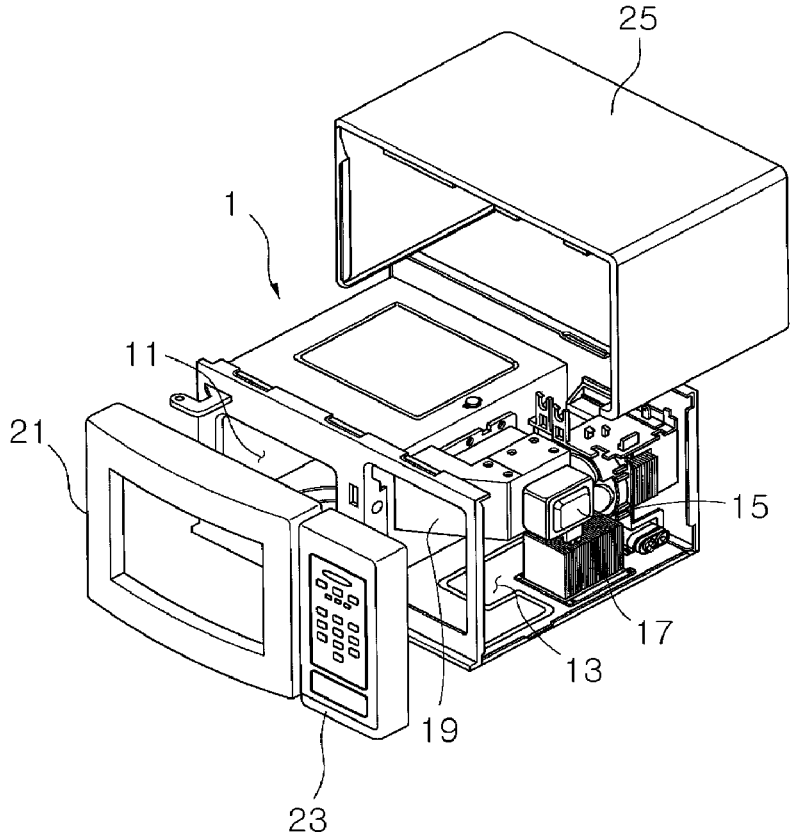
FIG. 1 is a perspective view of a microwave oven according to an embodiment.
Figure 2:
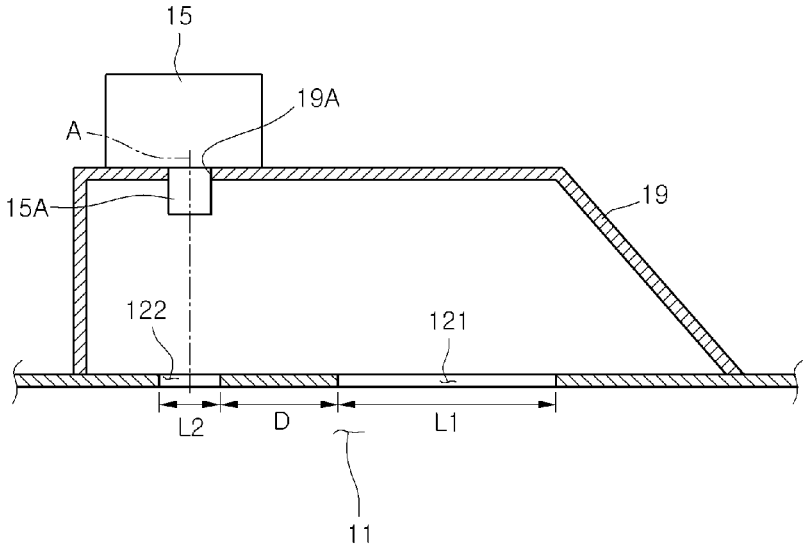
FIG. 2 is a cross-sectional view illustrating a major portion of the microwave oven of FIG. 1.

FIG. 1 is a perspective view of a microwave oven according to an embodiment, FIG. 2 is a cross-sectional view illustrating a major portion of the microwave oven of FIG. 1.

Referring to FIG. 1, a cooking chamber 11 is provided in a cavity 1 of a microwave oven. Food is cooked in the cooking chamber 11. The cavity 1 is provided at a side with two radiation openings 121 and 122 (see FIG. 2). The radiation openings 121 and 122 are for radiating the microwave radiation into the cooking chamber 11. The radiation openings 121 and 122 will be described in more detail later.

Meanwhile, an electronic component chamber 13 is provided in the cavity 1 at a right side of the cooking chamber 11 in the drawing. A plurality of electronic components such as a magnetron 15 and a high voltage transformer 17 for oscillating the microwave radiation are installed in the electronic component chamber 13. The magnetron 15 is provided with an antenna 15A through which the microwave radiation is substantially generated (see FIG. 2).

A waveguide 19 for guiding the microwave radiation oscillated from the magnetron 15 into the cooking chamber 11. A first end of the waveguide 19 is connected to the radiation openings 121 and 122. The magnetron 15 is installed on a second end of the waveguide 19. In addition, the waveguide 19 is provided with an antenna opening 19A in which the antenna 15A is fitted. In this embodiment, the microwave radiation is guided in a length direction of the waveguide 19 and transferred to the cooking chamber 11.

In addition, the cooking chamber 11 is selectively opened and closed by a door 21.

The door 21 is installed such that a first end thereof pivots a forward-reward direction about a second end thereof.

A control panel 23 is installed in front of the cavity 1, i.e., in front of the cooking chamber 11. The control panel 23 functions to receive manipulation signals for operating the microwave oven and display information on the operation of the microwave oven.

An outer case 25 is coupled to the cavity 1. The outer case 25 shields a top surface and both side surfaces of the cavity 1 including the electronic component chamber 13 and defines a top surface and both side surfaces of the microwave oven.

Referring to FIG. 2, when the radiation openings 121 and 122 are respectively referred to as first and second radiation openings, they are spaced apart from each other in the length direction of the waveguide 19, i.e., in a direction in which the microwave radiation is guided by the waveguide 19. The first radiation opening 121 is located at a downstream side in the direction where the microwave radiation is guided with respect to the second radiation opening 122.

In this embodiment, the first and second radiation openings 121 and 122 are formed in a rectangular shape. At this point, a length L1 of the first radiation opening 121 in the direction where the microwave radiation is guided by the waveguide 19 is set to be greater than λ/4. In addition, a length L2 of the second radiation opening 122 in the same direction is set to be less than λ/4. Preferably, the length L1 of the first radiation opening 121 in the direction where the microwave radiation is guided by the waveguide 19 may be set to be λ/2 and the length L2 of the second radiation opening 122 may be set to be λ/4. A distance D between the first and second radiation openings 121 and 122 in the direction where the microwave radiation is guided by the waveguide 19 may be a mean value of the lengths L1 and L2 of the respective first and second radiation openings 121 and 122. Accordingly, the distance D between the first and second radiation openings 121 and 122 in the direction where the microwave radiation is guided by the waveguide 19 may be set to be λ/4.

The above setting values L1, L2, and D are for uniformly radiating the microwave radiation into the cooking chamber 11. In more detail, the microwave radiation has a sine wave. That is the one wavelength λ/4 of the since wave microwave radiation has an amplitude that is 0 at 0, λ/2, and λ/and is maximum (peak) at λ/4 and 3λ/4.

However, since the microwave radiation oscillated from the magnetron is reflected in the course of being guided by the waveguide 19, the wavelength of the microwave radiation guided by the waveguide 19 is uneven. Therefore, the lengths L1 and L2 of the respective first and second radiation openings 121 and 122 and the distance between the first and second radiation openings 121 and 122 must be set such that the possibility that the microwave radiation guided by the waveguide 19 is transferred into the cooking chamber 11 increases.

Therefore, by designing the first and second radiation openings 121 and 122 with the above-described setting values (L1 is greater than λ/4, L2 is less than λ/4, and D is the mean value of the L1 and L2), the microwave radiation corresponding to the peak can be radiated into the cooking chamber 11 through one of the first and second radiation openings 121 and 122. Accordingly, even when the wavelength of the microwave radiation guided by the waveguide 19 is uneven, the microwave radiation can be uniformly radiated into the cooking chamber 11 through the first and second radiation openings 121 and 122.

In addition, a width of each of the first and second radiation openings 121 and 122 in a direction perpendicular to the direction where the microwave radiation is guided by the waveguide 19 is set to be equal to or less than a width of the waveguide 19.

Meanwhile, the lengths L1 and L2 and the distance D may be defined as nλ/2, nλ/8, and nλ/4 (n is an integer). Therefore, a ratio between the lengths N1 and N2 and the distance D may be defined as 4:1:2. That is, the first and second radiation openings 121 and 122 may be variably designed while keeping the ratio 4:1:2.

The first radiation opening 121 and the antennal opening 19A have central points located on an imaginary axis A identical to the length direction of the antenna 19. This is for more uniformly radiating the microwave radiation into the cooking chamber 11.

The following will describe the operation of the embodiment in more detail.

When a user inputs a manipulation signal trough the control panel 23, the magnetron 15 is driven to oscillate the microwave radiation through the antenna 15A. The microwave radiation oscillated from the antenna 15A is transferred into the cooking chamber 11 by the waveguide 19.

At this point, the microwave radiation is radiated into the cooking camber 11 through the first and second radiation openings 121 and 122. At this point, since the first and second radiation openings 121 and 122 are designed with the above-described setting values (L1 is greater than λ/4, L2 is less than λ/4, and D is the mean value of the L1 and L2), the microwave radiation can be uniformly radiated into the cooking chamber 11 through the first and second radiation openings 121 and 122. Therefore, the food can be more effectively cooked in the cooking chamber 11.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A microwave oven comprising:

a cavity having a cooking chamber;

a magnetron that oscillates microwave radiation used for cooking food in the cooking chamber; and first and second radiation openings through which the microwave radiation is radiated into the cooking chamber and formed on one surface of the cavity, each of the first and second radiation openings having a length in a direction where the microwave radiation is guided by a waveguide, the length of the first radiation opening being greater than λ/4 or the length of the second radiation opening being less than λ/4, wherein the second radiation opening overlaps an antenna of the magnetron in a length direction of the antenna.

2. The microwave oven according to claim 1, wherein the first and second radiation openings are spaced apart from each other in the direction where the microwave radiation is guided by the waveguide.

3. The microwave oven according to claim 1, wherein the length of the first radiation opening is λ/2; and the length of the second radiation opening is λ/8.

4. The microwave oven according to claim 3, wherein the first and second radiation openings are spaced apart from each other in the direction where the microwave radiation is guided by the waveguide.

5. The microwave oven according to claim 3, wherein the first radiation opening is located at a downstream side in the direction where the microwave radiation is guided by the wave guide with respect to the second radiation opening.

6. The microwave oven according to claim 1, wherein the second radiation opening and an antenna opening through which the antenna of the magnetron having the waveguide is fitted have central points located on an imaginary axis identical to a length direction of the antenna.

7. A microwave oven comprising:

a cavity having a cooking chamber;

a magnetron having an antenna that oscillates microwave radiation used for cooking food in the cooking chamber;

a waveguide to guide microwave radiation oscillated from the magnetron to the cooking chamber and having an antenna opening in which the antenna is inserted;

a first radiation opening through which the microwave radiation is radiated into the cooking chamber, the first radiation opening having a length in a direction where the microwave radiation is guided by the waveguide, the length being greater than $\lambda/4$; and a second radiation opening through which the microwave radiation is radiated into the cooking chamber, the second radiation opening having a length in a direction where the microwave radiation is guided by the waveguide, the length being less than $\lambda/4$, wherein a distance between the first and second radiation openings in a length direction of the waveguide is a mean value of the lengths of the first and second radiation openings, wherein the second radiation opening overlaps the antenna opening in a length direction of the antenna.

8. The microwave oven according to claim 7, wherein the length of the first radiation opening is $\lambda/2$; and the length of the second radiation opening is $\lambda/8$.

9. The microwave oven according to claim 7, wherein a central point of the first radiation opening is located on an imaginary axis identical to a length of the antenna.

10. A microwave oven comprising:

a cavity having a cooking chamber;

a magnetron that oscillates microwave radiation used for cooking food in the cooking chamber; a first radiation opening through which the microwave radiation guided by a waveguide is radiated into the cooking chamber; and a second radiation opening through which the microwave radiation guided by the waveguide is radiated into the cooking chamber, wherein lengths of the first and second radiation openings in a length direction of the waveguide and a distance between the first and second radiation openings in the length direction of the waveguide are $n\lambda/8$ (n is an integer), wherein the second radiation opening overlaps an antenna of the magnetron in a length direction of the antenna.

11. The microwave oven according to claim 10, wherein the length of the first radiation opening, the length of the second radiation opening, and the distance between the first and second radiation openings are respectively $n\lambda/2$, $n\lambda/8$, and $n\lambda/4$ (n is an integer).

12. The microwave oven according to claim 10, wherein a ratio between the length of the first radiation opening, the length of the second radiation opening, and the distance between the first and second radiation openings is 4:1:2.

13. The microwave oven according to claim 10, wherein central points of the second radiation opening and the antenna provided on the magnetron with the waveguide are located on an imaginary axis identical to a length direction of the antenna.

* * * * *